US006264545B1

(12) United States Patent
Magee et al.

(10) Patent No.: US 6,264,545 B1
(45) Date of Patent: Jul. 24, 2001

(54) METHOD AND APPARATUS FOR COIN PROCESSING

(75) Inventors: William D. Magee, Wolfeboro, NH (US); Robert A. Allexon, Killingworth, CT (US)

(73) Assignee: The Magee Company, Durham, CT (US)

( * ) Notice: Subject to any disclaimer, the term of this patent is extended or adjusted under 35 U.S.C. 154(b) by 0 days.

(21) Appl. No.: 09/513,909

(22) Filed: Feb. 26, 2000

(51) Int. Cl.[7] ..... G07D 3/00
(52) U.S. Cl. ..... 453/3
(58) Field of Search ..... 194/350; 232/15, 232/16; 453/3–17

(56) References Cited

U.S. PATENT DOCUMENTS

| | | | |
|---|---|---|---|
| 1,068,782 | | 7/1913 | Kohler . |
| 1,210,732 | | 1/1917 | Voglesong . |
| 1,418,770 | | 6/1922 | Woods et al. . |
| 1,525,116 | | 2/1925 | Buel . |
| 1,831,781 | | 11/1931 | Sobczak . |
| 3,266,611 | | 8/1966 | Kovar . |
| 4,108,296 | | 8/1978 | Hayashi et al. . |
| 4,124,111 | | 11/1978 | Hayashi . |
| 4,462,513 | | 7/1984 | Dean et al. . |
| 4,625,851 | | 12/1986 | Johnson et al. . |
| 4,878,573 | * | 11/1989 | Kobayshi et al. ..... 453/15 |
| 4,881,918 | | 11/1989 | Goh et al. . |
| 4,911,280 | * | 3/1990 | Bruner ..... 453/9 |
| 4,995,848 | | 2/1991 | Goh . |
| 5,197,588 | * | 3/1993 | Furuya et al. ..... 453/17 |
| 5,954,576 | * | 9/1999 | Coulter et al. ..... 453/17 |

FOREIGN PATENT DOCUMENTS

WO 93/02431 2/1993 (WO) .

* cited by examiner

*Primary Examiner*—Robert P. Olszewski
*Assistant Examiner*—Bryan Jaketic
(74) *Attorney, Agent, or Firm*—Pepe & Hazard LLP

(57) ABSTRACT

A stream of coins of mixed denominations is passed through a first station in which the mixed coins are counted and the stream of mixed coins is then sorted to segregate coins of a selected denomination from those of other denominations. The coins of the other denominations are deposited into a first vault chamber, and the coins of the selected denomination are deposited into a second vault chamber. A report of the value of the counted coins of all denomination is generated. At a processing station to which the vault chambers are transported, the coins of the selected denomination in the second vault chamber from repeated sorting operations by many users can be weighed to determine the total value thereof. Thus, only the coins of other denominations need to be counted and separated into denominations, thereby reducing the processing time, the wear on high speed counting and sorting apparatus, and the costs of coin processing.

21 Claims, 15 Drawing Sheets

METHOD AND APPARATUS FOR COIN PROCESSING

BACKGROUND OF THE INVENTION

The present invention relates to methods for processing mixed coins to determine the value thereof and, more particularly, to such methods in which mixed coins are segregated.

In recent years there have been developed machines which allow users to insert a large volume of mixed coinage and which process to coins to determine the total value thereof while counterfeits, mutilated coins and foreign coins are rejected and returned to the user. The user receives a printout indicating the total value of the coins which have been accepted, and this slip can be presented to a cashier in the supermarket or other facility where the processing machine is located for redemption in U.S. currency.

The coins which are received in the processing unit are generally stored in mixed condition in a vault within the processing unit. Periodically, the vault is removed and taken to another site for further processing such as an armored car carrier's facility or a bank vault. At that facility, the large volume of coins which have now been collected is sorted and valued in high speed counting and sorting equipment.

It is known that the pennies comprise by far the largest volume of the coins which are passed through such coin processing facilities. It is further known that the processing of mixed coins in high speed counting and sorting equipment produces substantial wear and tear on the equipment, and this is a factor in the service charge which the initial user incurs in his or hers processing of the mixed coinage.

It is an object of the present invention to provide a novel method for processing mixed coinage in which the coins of the denomination constituting the largest volume can be segregated, separately stored and ultimately separately processed at the final processing location.

It is also an object to provide such a coin processing method in which the sorting and counting of the coins at the final processing facility can be performed expeditiously to reduce the cost and time required for processing such coins.

Another object is to provide a novel coin processing apparatus which segregates the coin denomination of largest volume to facilitate further processing.

A further object is to provide such coin processing apparatus which may be simply and economically fabricated and in which the coins are stored in a removable vault which may be readily transported.

A still further object is to provide such coin processing apparatus in which the vault in which the coins are stored enables ready removal of the mixed coins and determination of the segregated denomination is effected by weighing of the vault with that denomination of coins remaining therein.

SUMMARY OF THE INVENTION

It has now been found that the foregoing and related objects may be readily attained in a method for counting coins of mixed denominations and segregating coins of a single denomination from those of other denominations, in which a stream of coins of mixed denominations is passed through a first station in which all coins are counted to determine the total value thereof. The stream of mixed coins is sorted to segregate coins of a selected denomination from coins of other denominations, and the coins of other denominations are deposited into a first vault chamber. The segregated coins of the selected denomination are deposited into a second vault chamber and a valuation of the counted coins is provided.

Usually, the method involves a further step of weighing the segregated coins of the selected denomination in the second vault chamber after multiple customer transactions to determine the total value thereof. Usually, the coins are United States coinage and the selected denomination is a penny, and the sorting step removes the coins in the mixed stream by denomination with any dimes in the stream being channeled to the stream of mixed coins which are of denomination larger than pennies.

Generally, the coin sorting step offsorts the segregated coins of the selected denomination from the stream of coins exiting the counting step into the second vault chamber, while the stream of the remaining coins is directed into the first vault chamber. The counting step also removes from the stream of mixed coins foreign, mutilated and counterfeit coins, and the removed coins are separately discharged.

The vault chambers may be separable, and the method will include the step of weighing the second vault chamber with the selected coins therein to determine its weight and thereby the total value of the coins of the selected denomination.

This will usually take place at a processing station and the method includes the steps of periodically transporting the vault chambers with the coins therein to a processing center and weighing the segregated coins in the second chamber to determine the value thereof. Preferably, the vault chambers are formed in a single vault and the method includes the step of removing the mixed coins from the first chamber and weighing the vault thereafter. At the processing center, the mixed coins are removed from the first chamber and the mixed coins are counted and sorted.

A coin processor for counting coins of mixed denominations and segregating coins of a selected denomination from those of other denominations comprises a housing having an upper portion and a lower portion providing a vault receiving chamber. A vault is removably seated in the vault receiving chamber and provides a first coin receiving chamber and a second coin receiving chamber. In the upper portion of the housing is a coin counter for receiving coins of mixed denominations and counting all coins. A coin sorter is also provided in the upper portion for segregating a stream of mixed coins exiting the counter into a stream of coins of a selected denomination and a stream of coins of other mixed denominations. A first conduit for the stream of coins of other mixed denominations extends to the first chamber in the vault, and a second conduit for the stream of coins of the selected denomination extends to the second chamber in the vault. The processor also includes indicia providing means for displaying the total value of the counted coins.

In one embodiment, the first chamber is removable from the vault and the vault has a door to access the first chamber and which may be locked for security. In another embodiment, the vault has separate discharge ports for each of the chambers through which the coins therein may be separately discharged.

Preferably, the coin sorter includes a channel for a stream of coins and means along the channel for segregating the coins of the selected denomination. When the coins to be sorted are those of the United States and the selected denomination being a penny, the sorter includes means for combining dimes with the stream of larger diameter coins.

Desirably, the counter includes means for removing foreign, counterfeit and mutilated coins and a discharge chute for the removed coins. Conveniently, the indicia providing means is a printer. The housing has an opening therein, an access door closing the opening through which the vault may be removed, and means for locking the access door. The vault desirably includes wheels on which the vault may be moved and an engageable element which can be engaged to remove it from the housing. The vault may also have recesses in its bottom end for seating the forks of a fork lift to move the vault at the processing center.

DETAILED DESCRIPTION OF THE PREFERRED EMBODIMENT

Figure 1:
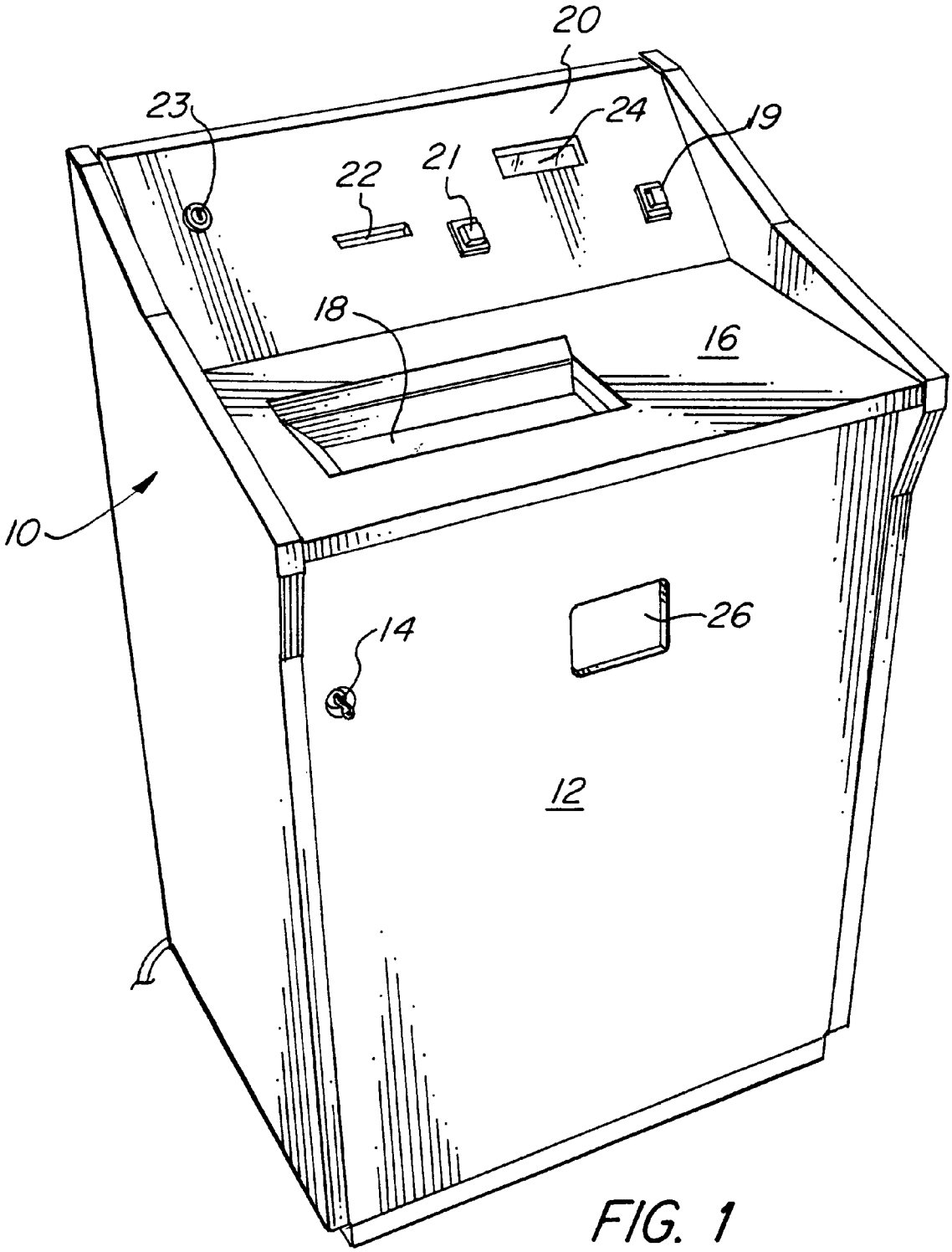
FIG. 1 is a front perspective view of a coin processing unit embodying the present invention.

Turning first to FIG. 1, therein illustrated is a coin processing unit embodying the present invention. The housing generally designated by the numeral 10 has an access door 12 with a key lock 14. The top wall 16 has a hopper 18 into which mixed coins are introduced for processing. On the rear panel 20 is a display screen 24 and a slot 22 through which a printed record is discharged. Also on the panel 20 are start and printer buttons 19 and 21. When the key lock 23 is released, the panel 20 may be pivoted downwardly to enable servicing of the printer (not seen) and other components on or behind the panel 20. In the access door 12 is a reject chute 26 into which foreign, mutilated and counterfeit coins are discharged.

Figure 2:
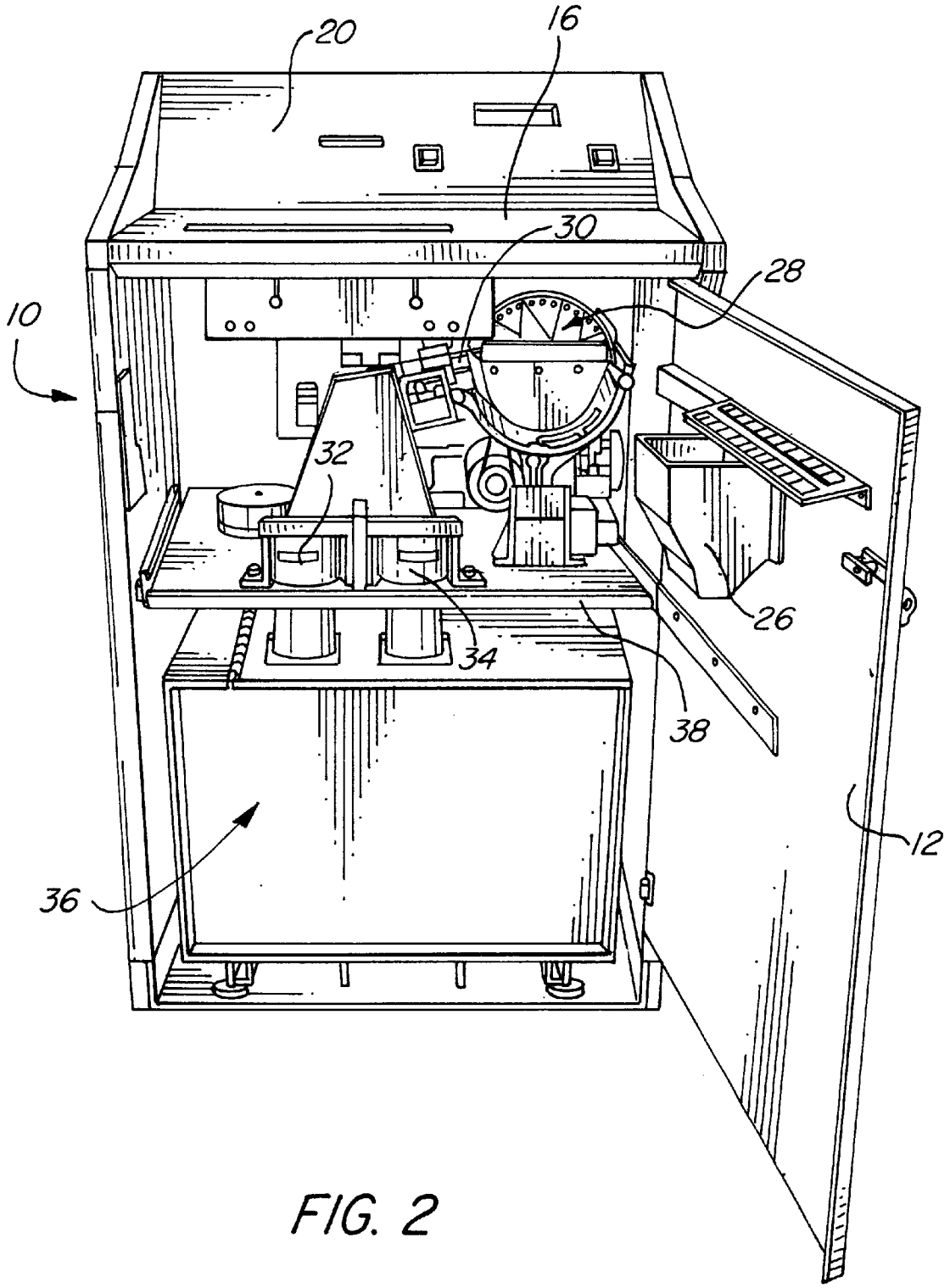
FIG. 2 is a front perspective view of the coin processing unit with the front panel opened.
Figure 3:
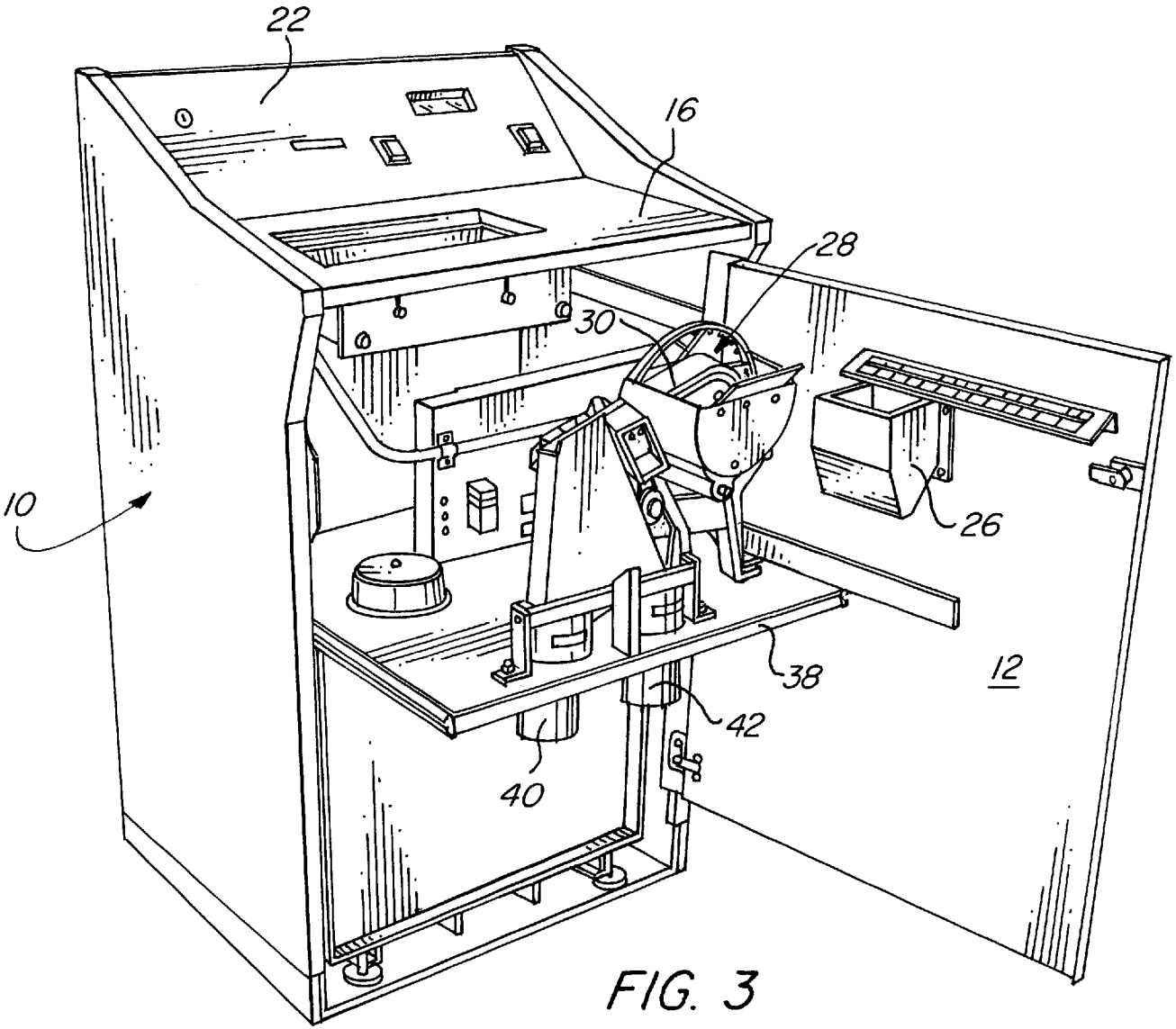
FIG. 3 is a perspective view of the coin processing unit with the processing mechanism support slid outwardly.

Turning next to FIGS. 2 and 3, opening of the door 12 allows access to the vault generally designated by the numeral 36. Mounted on the slide base 38 are the coin counter generally designated by the numeral 28 and the coin sorting rail 30 which receives the coins from the counter 28. Coins from the hopper 18 are conveyed by a conveyor belt (not shown) to the counter 28.

As the coins exiting the counter 28 pass along the rail 30, coins other than pennies are diverted into the chute 34 and the pennies are diverted into the penny chute 32. Coins rejected by the counter 28 are diverted into the reject chute 26.

As seen in FIG. 3, the slide base 38 can be pulled outwardly of the housing 10 for servicing the counter 28, rail 30 and other components.

Figure 4:
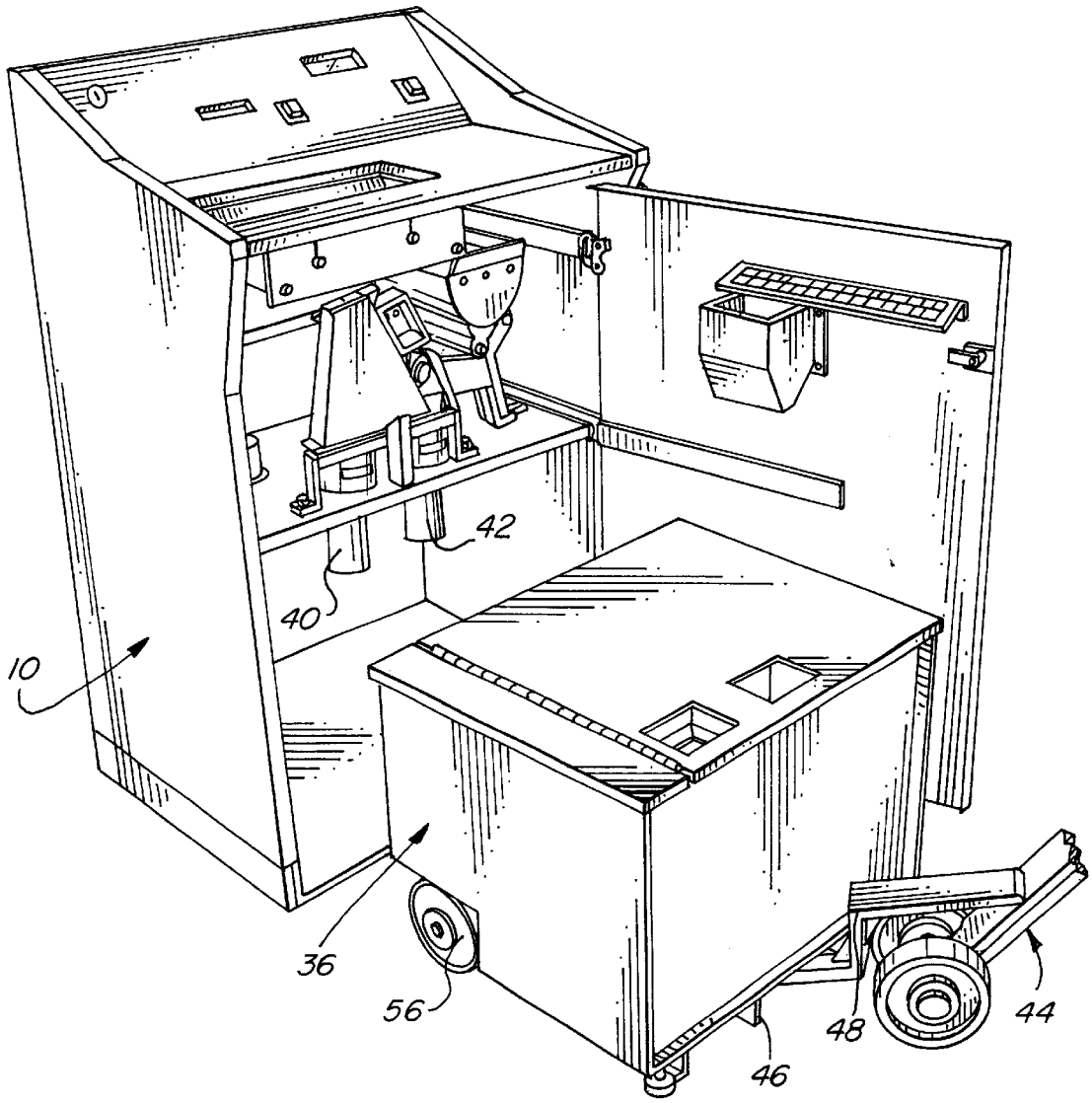
FIG. 4 is a perspective view of the coin processing unit with the vault moved outwardly thereof by a dolly.
Figure 5:
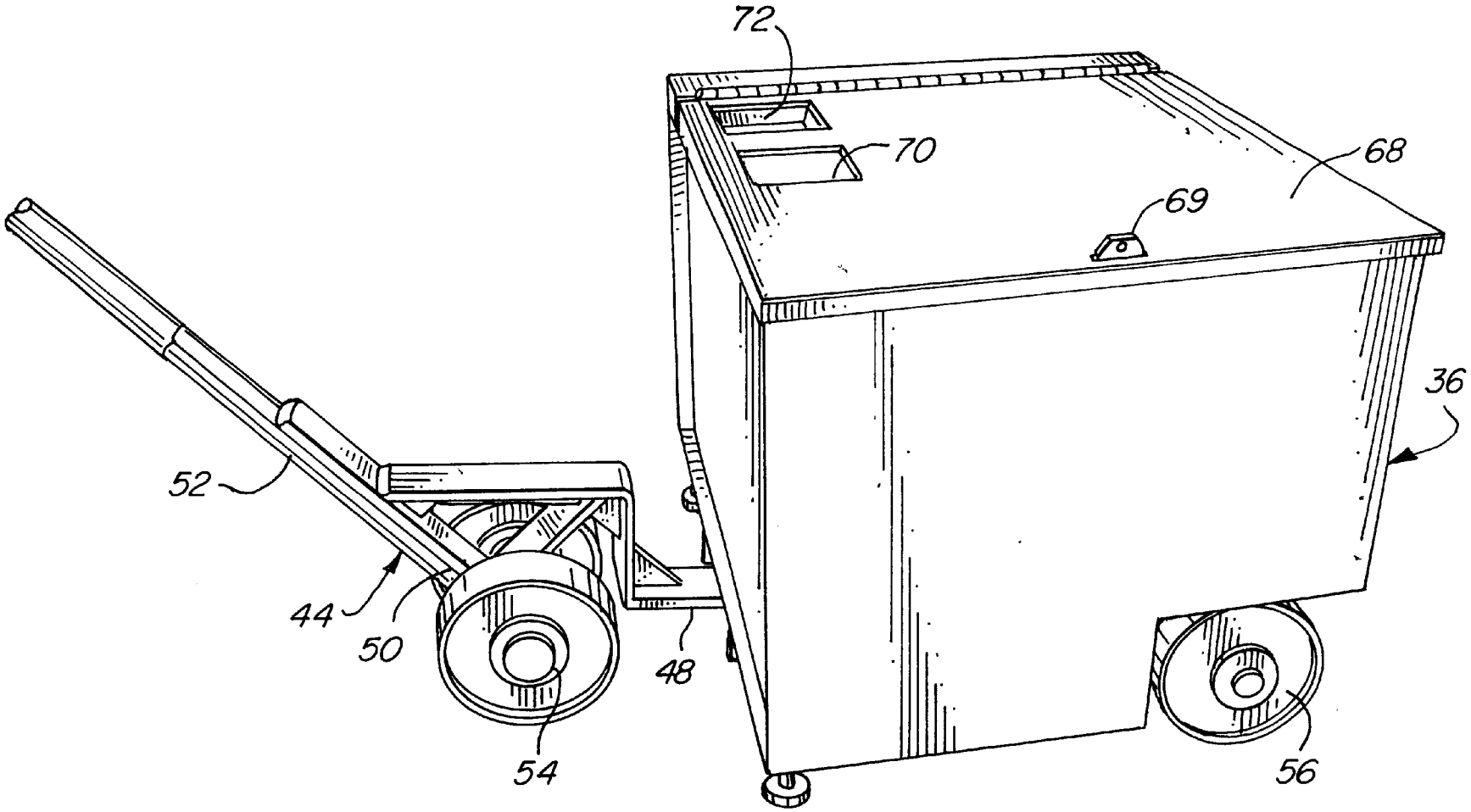
FIG. 5 is a perspective view of the vault and dolly with the vault cover in place.

Turning next to FIGS. 4 and 5, the vault 36 can be seen to have wheels 56 on its inner end, and it can be engaged and moved outwardly of the housing 10 by a dolly generally designated by the numeral 44 which has a projecting arm 48 which will slide between channel members 46 on the bottom of the vault 36. Adjacent the end of the arm 48 is an upstanding pin (not shown) which will seat in an aperture in the bottom wall of the vault 36. As seen in FIG. 4, depending from the slide base 38 are a penny discharge 40 and a mixed coin discharge 42 which are aligned with the penny feed port 72 and mixed coin feed port 70 in the cover 68 of the vault 36.

The dolly 44 has a frame 50 on which wheels 54 are mounted and a handle 52 by which the dolly 44 and vault 36 may be tilted to lift the outer end of the vault for movement on the wheels 54 and 56.

As seen in FIG. 5, the cover 68 has an opening therein through which a latch ear 69 extends. A lock (not shown) is secured in the latch ear 69 to lock the cover 68 closed both when in the coin processor and for transport.

Figure 6:
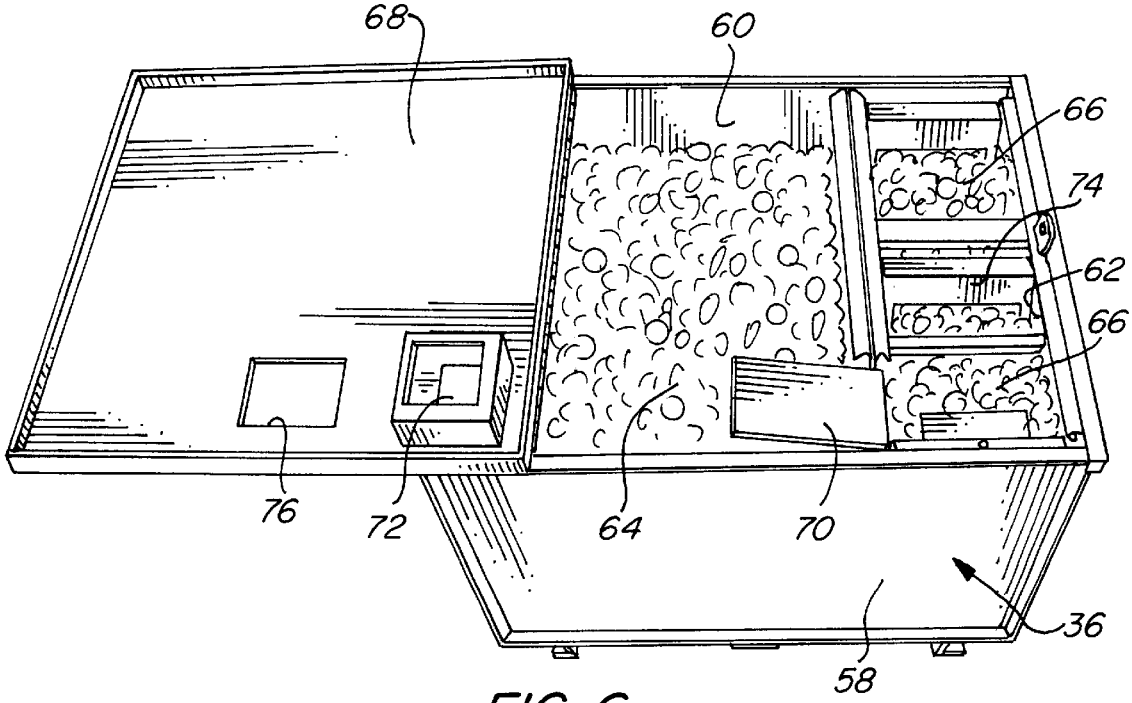
FIG. 6 is a perspective view of the vault with the cover pivoted open and with coins disposed therein.

As seen in FIG. 6, the cover 68 of the vault 36 may be pivoted into an open position for access to the interior which includes the penny vault chamber 60 and the mixed coin insert 62. The cover 68 has an aperture 76 for the mixed coins which registers with the mixed diverter 70 which diverts the mixed coins into the mixed coin insert 62. The cover 68 also has the penny feed port 72. In FIG. 6, mixed coins 66 are shown in the insert 62 and pennies 64 are shown in the vault chamber 60.

Figure 7:
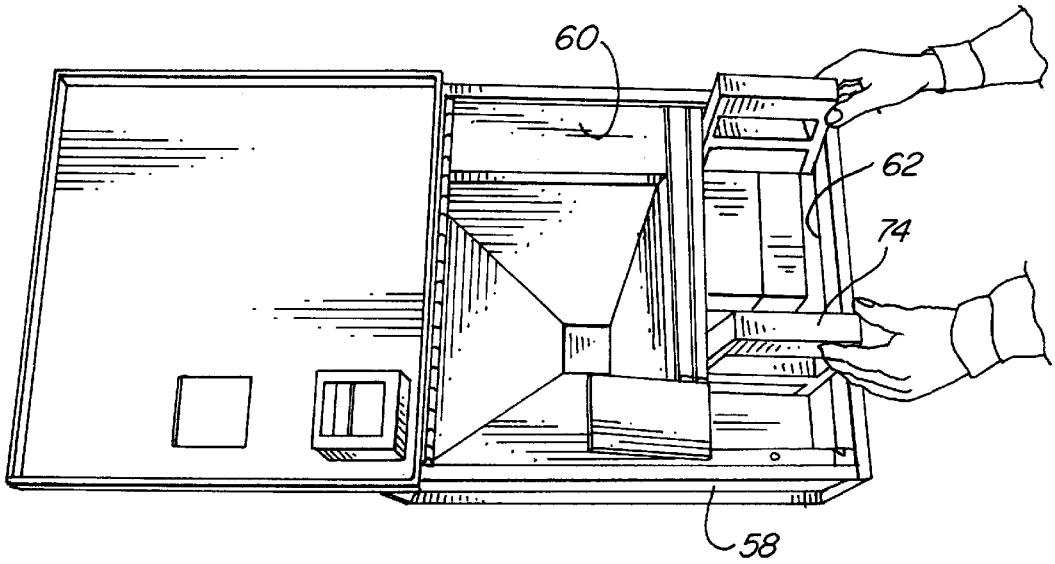
FIG. 7 is a perspective view of the vault with the cover open and showing the mixed coin insert with its handles pivoted upwardly for removal from the vault.
Figure 8:
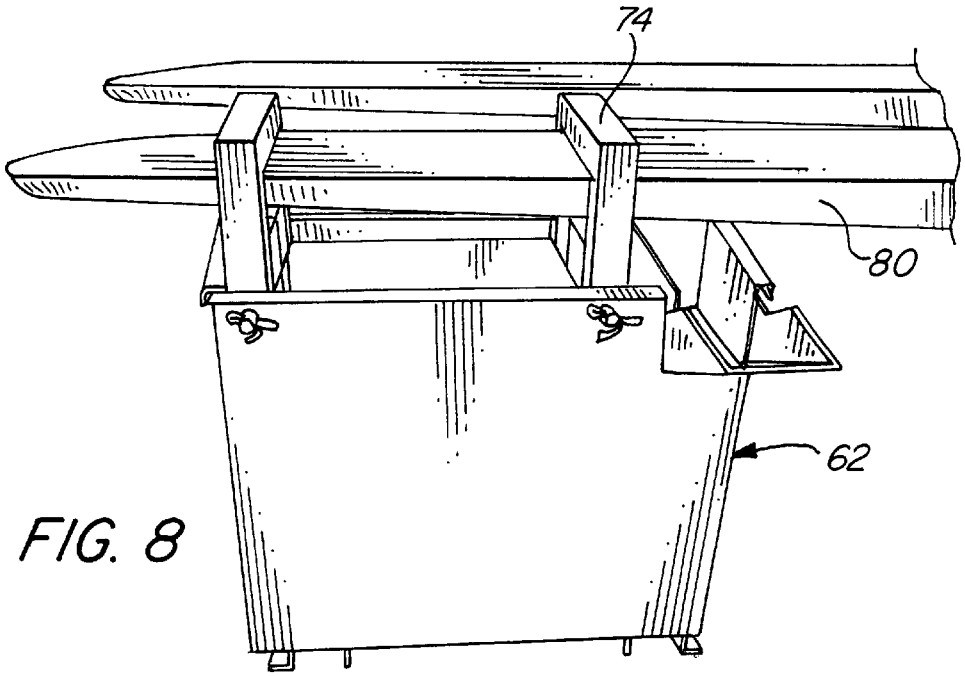
FIG. 8 is a perspective view of the coin insert being lifted by a fork lift.

In this embodiment of vault 36, after pivoting the cover 68 into the open position at the processing facility, a pair of handles 74 on the mixed coin insert 62 may be pivoted upwardly to allow the insert to be lifted upwardly from the vault 36, as seen in FIG. 7. As seen in FIG. 8, these handles 74 are dimensioned to seat on a fork 80 of a fork lift generally designated by the numeral 78, thus facilitating movement of the insert 62 at the processing facility.

Figure 9:
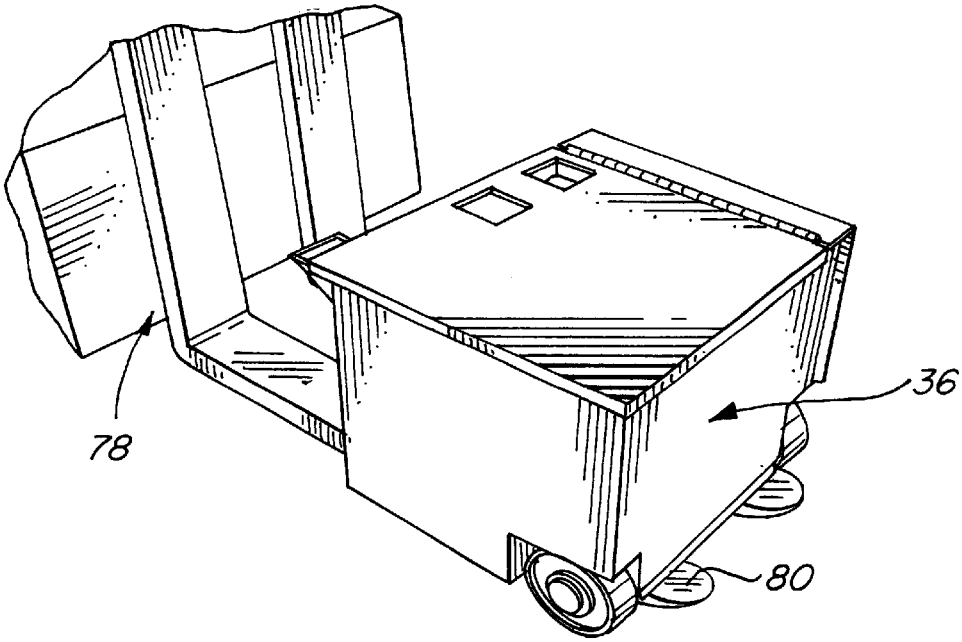
FIG. 9 is a perspective view of the vault being transported on a fork lift truck.

As seen in FIG. 9, the entire vault 36 can be moved easily by supporting it on the forks 80 of the fork lift 78. The forks 80 seat between the channel members 46 on the bottom wall.

Figure 10:
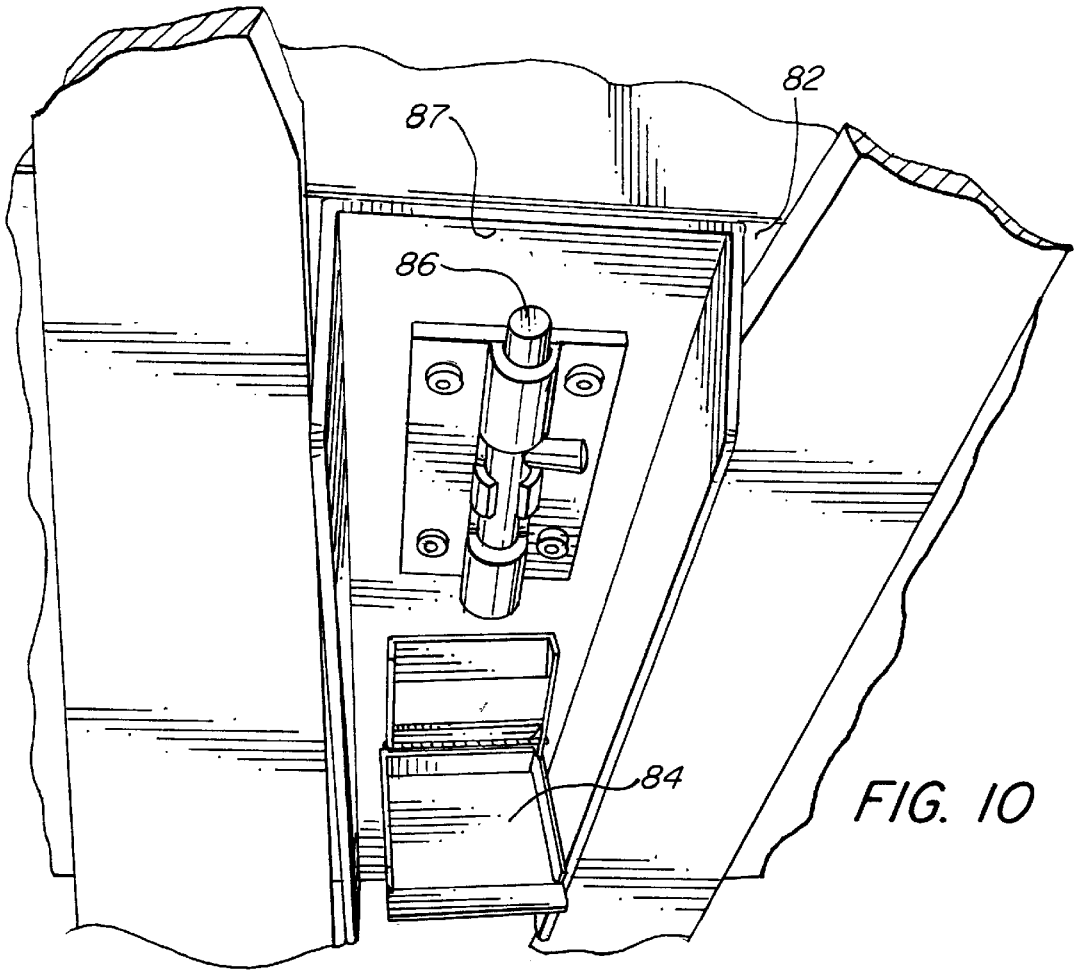
FIG. 10 is an enlarged fragmentary perspective bottom view of the bottom of the vault on the fork lift.
Figure 11:
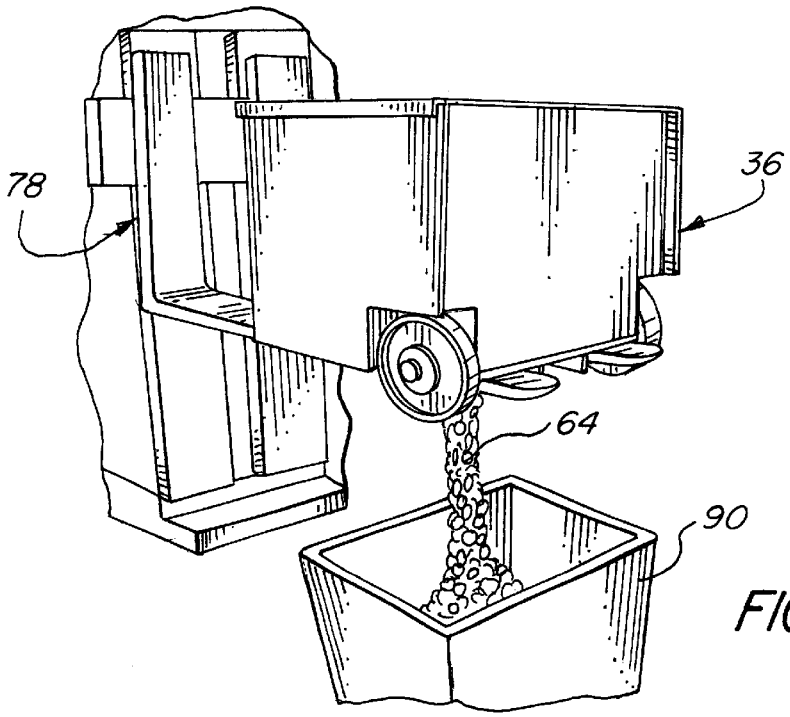
FIG. 11 is a perspective view of the vault supported above a receptacle into which the pennies are being transferred.

Turning next to FIGS. 10 and 11, the pennies can be discharged from the chamber 60 through a pivotally mounted drain door 84 on the bottom wall 82 which is held normally closed by the slide bolt 86. This drain door 84 and bolt 86 are protected with a channel member 87. When the vault 36 is elevated by the fork lift 78, the drain door 84 can be opened to discharge the pennies into a container 90.

Figure 12:
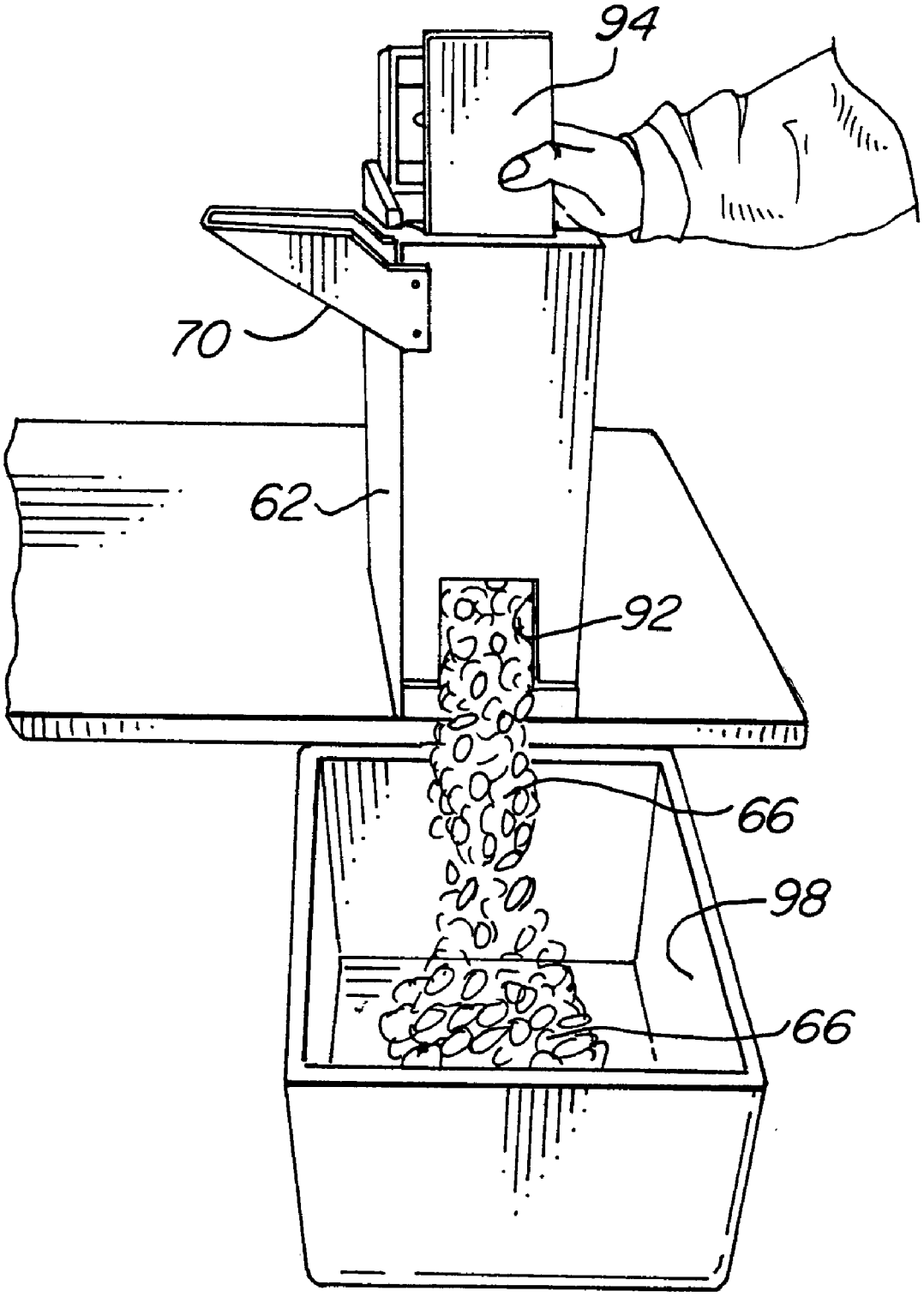
FIG. 12 is a perspective view of the mixed coins being drained from the vault insert into a receptacle.

As seen in FIG. 12, the mixed coin insert 62 can be emptied at the processing facility by sliding the drain door 94 upwardly to unblock the drain opening 92. The coins flow therethrough and are collected in the container 98. Also clearly seen in this view is the diverter chute 70 which laterally offsets the flow of mixed coins passing through the aperture 76 in the cover 68. When the insert 62 is in the vault 36, the drain door 94 is held in position by the cover 68.

Figure 13:
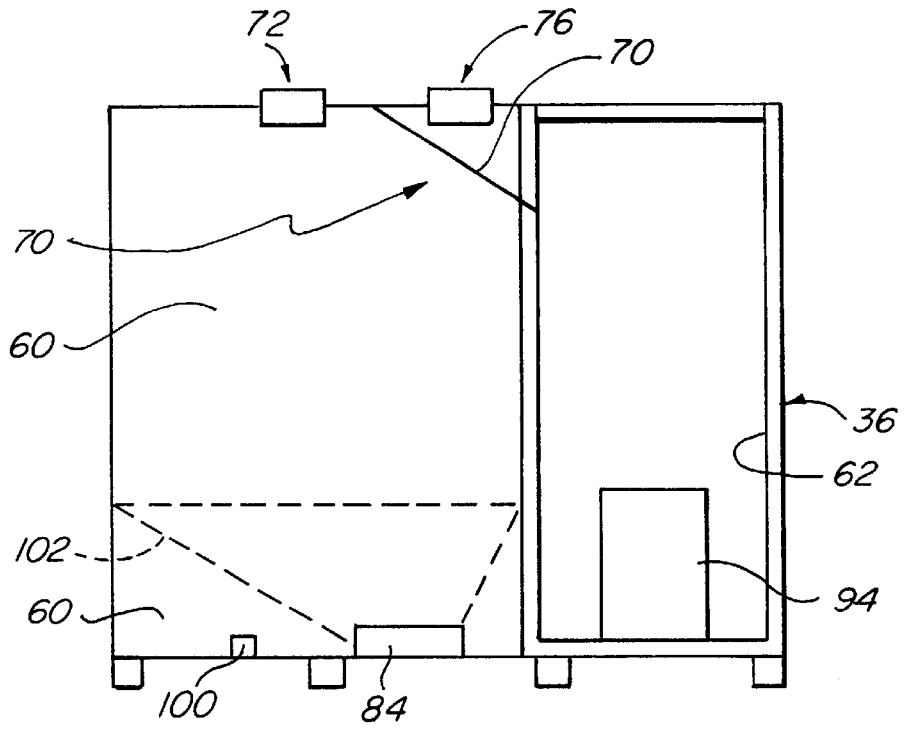
FIG. 13 is a diagrammatic front view of the coin vault.
Figure 14:
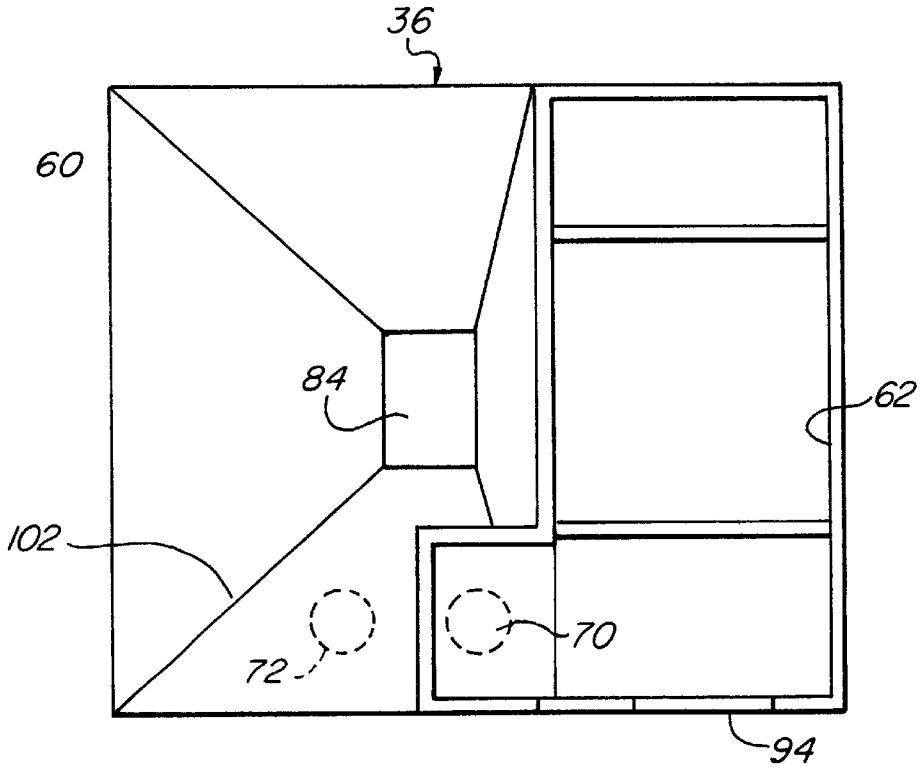
FIG. 14 is a diagrammatic top view of the vault of FIG. 13.

The construction of the vault 36 is diagrammatically illustrated in FIGS. 13 and 14. As illustrated in broken line the bottom of the vault chamber 60 has walls which slope towards the drain door 84 to provide a funnel 102. The aperture 100 in the bottom wall for engagement of the pin on the dolly 44 is in an area near the front wall of the vault and below the funnel 102.

Figure 15:
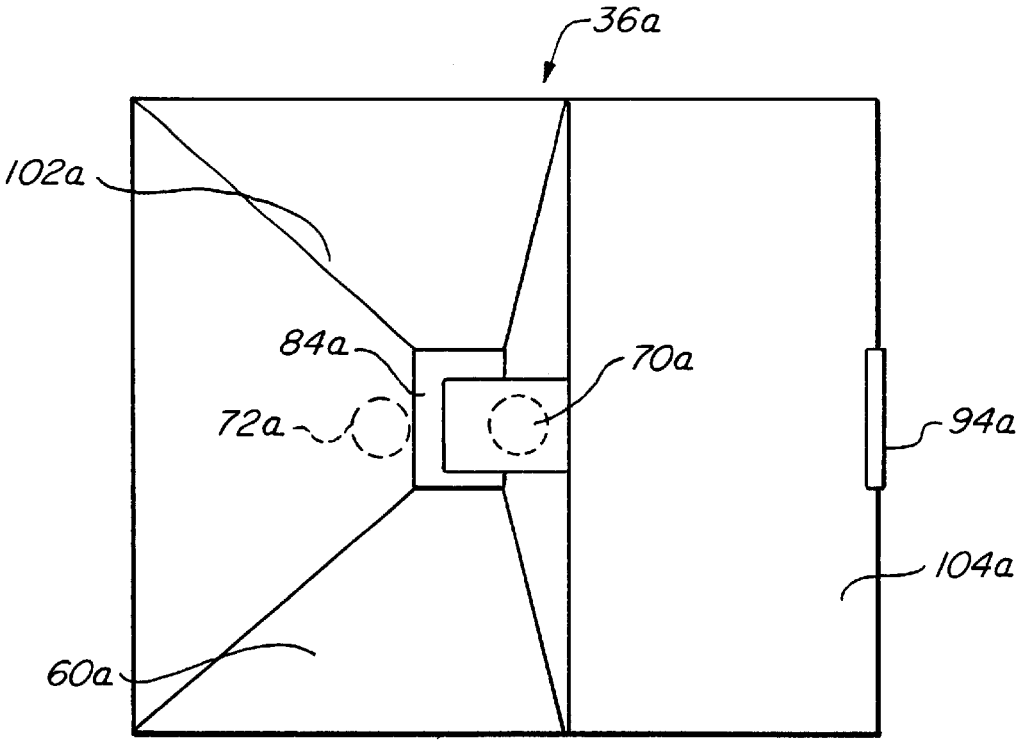
FIG. 15 is a diagrammatic top view of a preferred vault construction with the cover removed.
Figure 16:
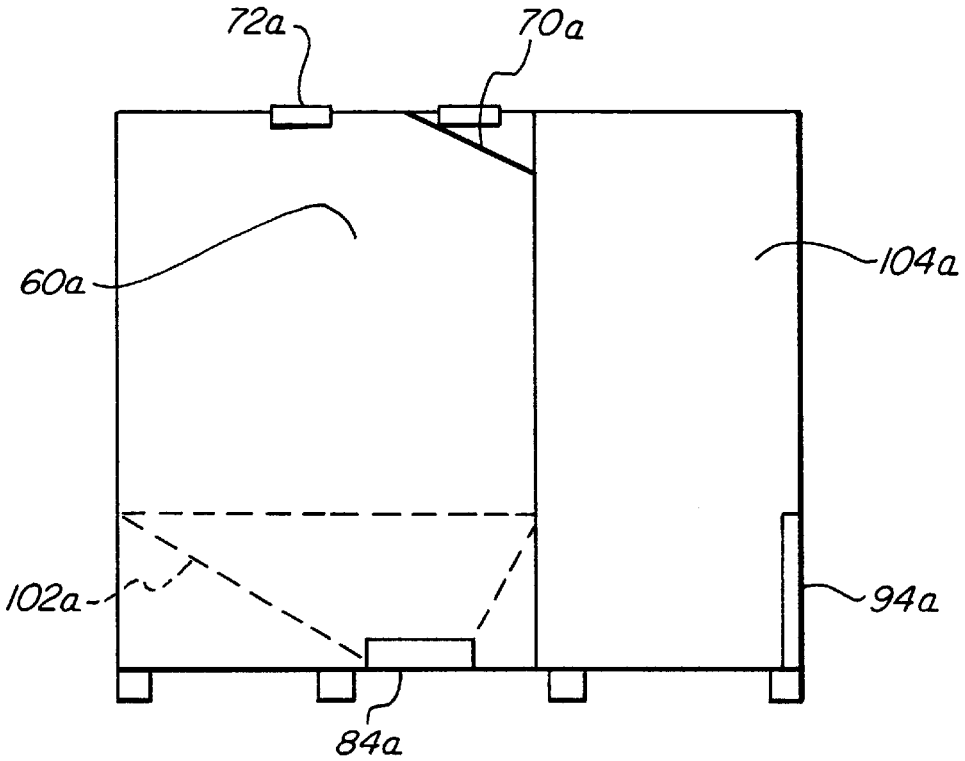
FIG. 16 is a diagrammatic front view of the vault of FIG. 15.

FIGS. 15 and 16 diagrammatically illustrate another vault 36*a* which has a penny vault chamber 60*a* and a fixed mixed coin chamber 104*a* which has a drain door 94*a* in the side wall of the vault 36*a*. In this embodiment, the penny feed port 72*a* and mixed coin diverter 70*a* are adjacent the center of the vault 36*a,* and the chutes (not shown) from the rail 30 are reoriented to feed thereinto.

Figure 18:
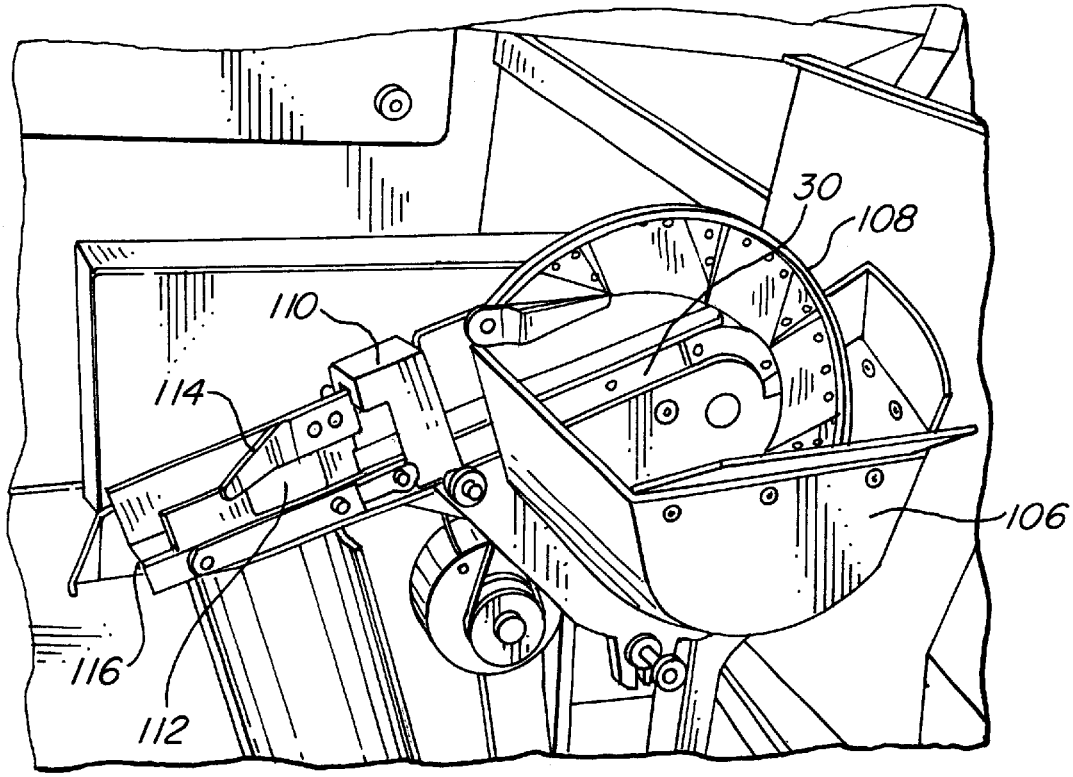
FIG. 18 is a perspective view of the coin processing apparatus.
Figure 17:
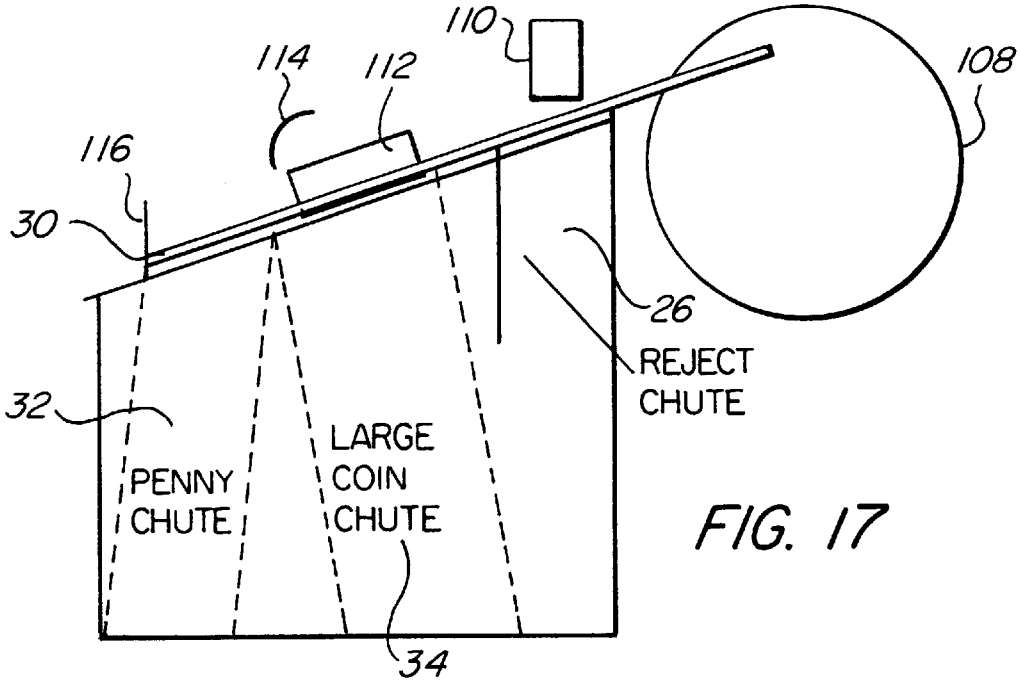
FIG. 17 is a diagrammatic view of the coin processing apparatus.

FIG. 17 diagrammatically illustrates the counter and rail assembly and FIG. 18 illustrates the actual structure. Mixed coins in the receptacle 106 are picked up on the side surface of the rotating disc 108 which delivers them one at a time to the rail 30. As the coins roll down the rail 30, they pass by the alloy sensor 110 which determines their denomination and sends a signal to the counter mechanism (not shown). As the coins proceed further down the rail 30, dimes are diverted at the dime window 112, and coins other than pennies are picked off at the large coin pick off 114 and dropped into the mixed coin chute 34 along with the dimes. The pennies continue to the penny pick off 116 where they are dropped into the penny chute 32. Coins rejected by the alloy sensor 110 are diverted to the reject chute 26.

In the method using the coin processor of the present invention, the user pours the coins of mixed denomination into the hopper 18 and presses the "start" button 19. The coins are picked up by the rotating disk 108 from the receptacle 106 and it feeds them one at a time onto the inclined rail 30. As they pass the alloy sensor 110, the denomination of the coins is noted and appropriate signals are registered in the counting unit (not shown); mutilated, foreign and counterfeit coins are directed into the reject chute 26 from which they can be recovered.

As the coins proceed down the rail 30, dimes (which are smaller in diameter than pennies) fall through the dime window 112 and into the other coin chute 34. At the large coin pickoff 114, nickels, quarters, half dollars and dollars are directed into the other coin shute 34. Finally, at the bottom of rail 30, the pennies are directed into the penny chute 32 and flow into the penny vault chamber 60. The other coins flow into the mixed coin insert 62 (or mixed coin vault chamber 104).

After all of the coins in the hopper 18 have been processed, the printer button 21 lights and is enabled. The user presses the printer button 21 and receives a printout from the printer output slot 22 and a visual image on the display 26. The user can take the printout to the cashier to receive paper currency (and coins).

As is customary, there is a service charge for use of the processor and the computer program calculates the charge and deducts it from the value of the coins processed. The printout includes the several values.

After several days (the period may be based upon past experience, or upon a customers call, or as a result of a call from the store where the processor is located), the driver of an armored car service or coin processor operation company opens the access door 12 and inserts the projecting arm 48 of the dolly 44 into the vault 36 and withdraws it from the housing 10. A lock (not shown) is inserted through the latch ear 69 on the top of the vault 36, and the vault 36 is then rolled to the rear lift gate of a vehicle (not shown), elevated on the gate, and rolled into the vehicle interior.

At the processing facility (usually an armored car facility or bank vault), the vault 36 is removed from the vehicle and moved to a first processing point, usually by a fork lift 78. The mixed coins are removed either by removing the insert 62 or by draining them through the drain opening 92. The vault 36 is transported to a second processing point where it is weighed. The difference between this weight and the tare weight of the vault is utilized to determine the total value of the pennies.

The coins of other denominations are introduced into a high speed coin counter/sorter which both determines the total value thereof and segregates the coins into their individual denomination.

Figure 19A:
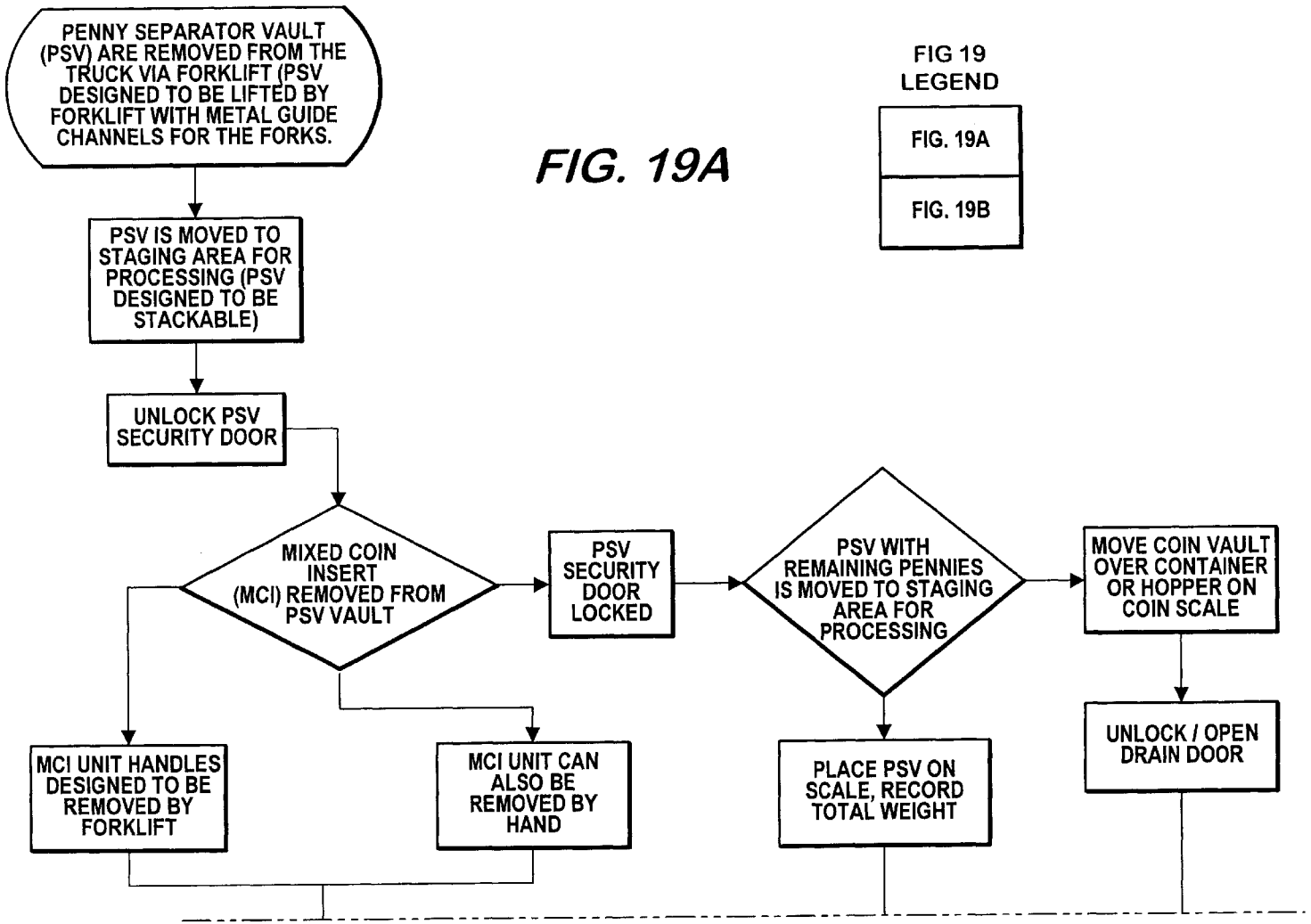
FIGS. 19*a* and 19*b* together comprise a diagrammatic flow chart of the operations at the coin processing facility.
Figure 19B:
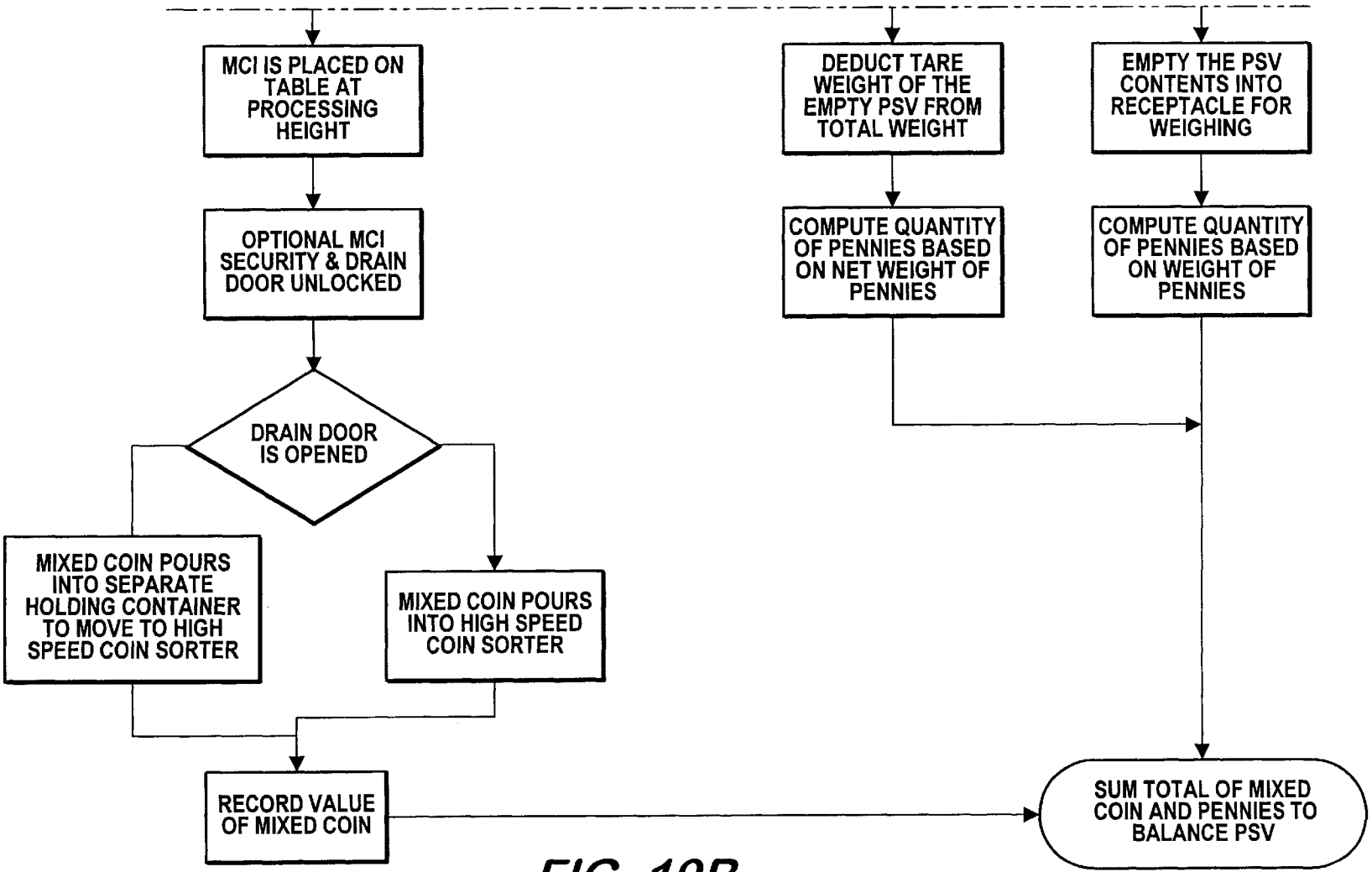

FIG. 19 is a flow chart showing various steps at the processing facility.

Figure 20:
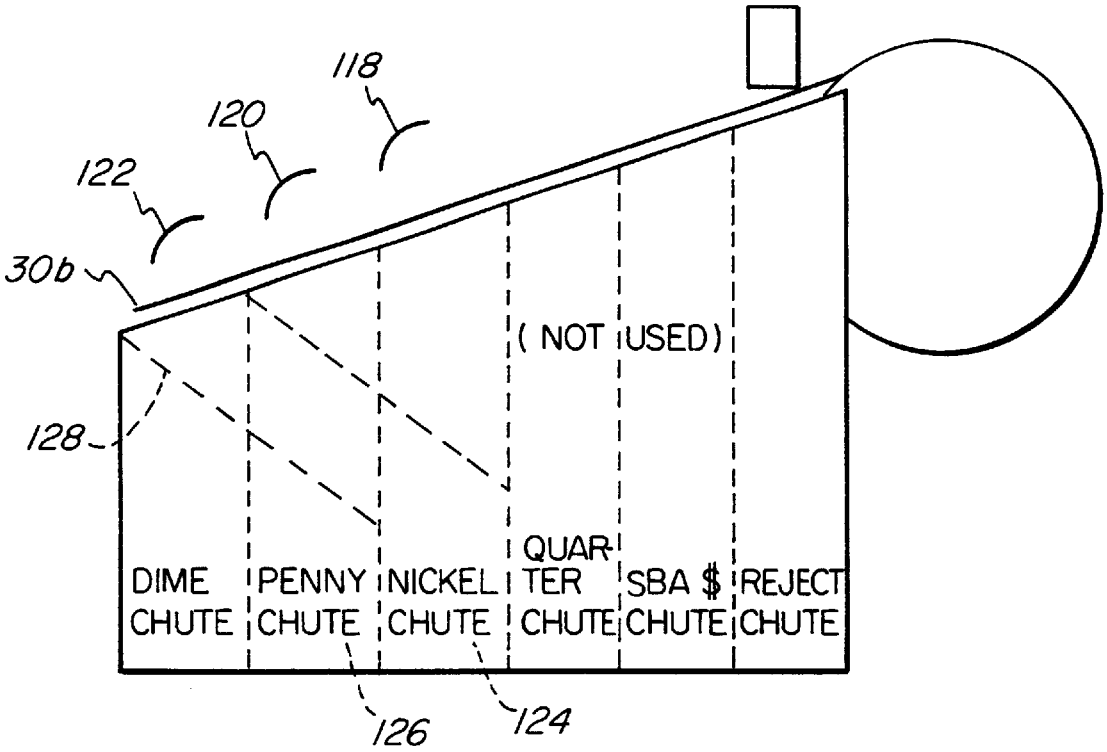
FIG. 20 is a diagrammatic view of the coin processing apparatus using a now preferred pick off sequence for the coins.

Because of some intermittent jamming problems which have been encountered in using the dime window to off sort the dimes at an initial station, it is presently considered preferable to off sort the dimes at the last station since the dime is the smallest coin. FIG. 20 diagrammatically illustrates a modification of a conventional off sorting rail 30*b* which initially off sorts the dollar, half dollar, quarter and nickels at a single pick off point 118, the pennies at the next pick off point 120, and the dimes at the last pick off point 122. The existing nickel chute 124 is used for all of the larger coins from the pick off point 118, the penny chute 126 is still used for the pennies, and a diverter chute 128 carries the dimes to the former nickel chute 124. Except as modified above, the operations are the same.

Although the foregoing description and drawings are directed to United States coinage, the apparatus and method can be adapted to the coinage of other countries by modification of the sorting section of the counter mechanism.

Readily available coin counting and sorting machines may be quickly adapted to the present invention, usually by modifying the sorter rail and chutes. Among such counter/sorters are those of CT Coin A/S of Odense, Denmark; Scan/Coin, Malnio, Sweden; and F. Zimmermann of Berlin, Germany.

Thus, the penny separator feature allows only the penny be separated while all other denominations are captured mixed. Since the penny is the predominant coin denomination in such processing, isolating it from the other coins allows for the implementation of alternative, and more efficient, processing methods in balancing the contents of the self-service coin machine itself.

Operation of the heretofore available coin processing devices either sorts the coins by diameter into separate containers for each coin, or the coins are counted and output as mixed coin into a single container for subsequent processing. Since the penny is in between the size of the United States dime and nickel in terms of its diameter, separating it without separating the other coins requires a unique approach to the sorting process itself.

The second consideration in separating the penny from the other denominations is in the container design itself, the coin receiving vault. The coin vault actually receives the coin that has been processed and counted by the self-service coin machine. Traditionally, these units contain only one section for receiving coin as all denominations are mixed together. In this processing method, the coins are actually sorted by denomination later when the vault contents are balanced, normally by an armored carrier or bank vault. Some self-service coin machines actually sort and count all denominations within the self-service unit itself. In such cases, the coins are received into bags, not a coin vault. The novel approach of the present invention to sorting the penny from the other denominations requires a coin vault with separate receiving sections for the penny and the rest of the coins as hereinbefore described.

Separating the penny from the other denominations in self-service coin processing gives us an outstanding advantage in coin vault balancing as the pennies, which normally constitute up to 75 percent of the coins received, can be processed in bulk rather than counted by the piece and sorted along with the other coins. This saves the processor, or the party bearing the expense of processing, significant time and expense over piece counting and sorting the entire contents of the coin vault. Costs reductions and processing charges can be reduced by up to 60 percent with the penny separator feature.

These savings are based on labor savings in the central processing site such as:

Less time to transport the vaults within the central site facility because they are fork lift compatible.

Less time to sort the coins on the high-speed sorter because only the nickel, dime, quarter, half dollar and dollar coins are sorted. This reduces piece volume by 60 to 75 percent, and has a direct relationship to labor savings.

There are also other financial savings including:

There is also reduction in wear and tear on the high-speed sorter itself directly comparable to the reduction in processing volume. This is significant in that the charges for maintenance on that device are normally passed on to the customer, and they are in addition to the processing charges.

Because the central site processing takes less time with the penny separation method as compared to alternate methods, there are fewer processing "bottlenecks" at the high-speed sorting station. The traditional method normally results in a significant processing backlog of coin vaults waiting for processing. This means that the coin vaults backlogged in the staging area are not available for redeployment until they are emptied of their contents and additional vaults must be purchased by the owner of the self-service machines to accommodate.

In addition to much faster processing, the penny separator vault offers an additional feature to reduce the problems associated with high-speed sorting backlogs. The mixed coin is captured in the vault in a mixed coin insert in one embodiment. In a backlog situation, it can be removed from the vault, placed in the staging area, and secured with its own locking cover. This way the pennies can be processed in bulk by weight. The vault then can be quickly emptied of all contents, and it can be immediately redeployed. With the penny separator vault, there is a reduced need to buy larger numbers of extra coin vaults only to have them collect in a staging area. Only the relatively inexpensive mixed coin inserts remain in staging and to a much lesser extent than with traditional processing methods.

Thus, it can be seen from the foregoing detailed description and accompanying illustrations that the coin processor of the present invention enables facile and relatively lower cost processing of mixed coins by segregation of the coin which comprises the largest percentage of such coins. Wear and tear on the high-speed sorters can be reduced, and processing of the segregated coinage enables various efficient options in workflow at the bank or armored car vault.

Having thus described the invention, what is claimed is:

1. In a method for counting coins of mixed denominations and segregating coins of a single denomination from coins of other denominations, the steps comprising:

(a) passing a stream of coins of mixed denominations through a first station in which all coins are counted to determine the total value thereof;

(b) sorting said stream of coins of mixed denominations to segregate coins of a selected denomination from coins of other denominations;

(c) depositing said coins of other denominations into a first vault chamber;

(d) depositing said segregated coins of said selected denomination into a second vault chamber; and (e) providing the valuation of the counted coins.

2. The method of counting coins of mixed denominations and segregating coins of a single denomination from coins of other denominations in accordance with claim 1 including the further steps of (a) repeatedly conducting said counting and sorting operations on batches of coins by a number of users; and (b) weighing said segregated coins of said selected denomination in said second vault chamber to determine the total value thereof.

3. The method of counting and segregating mixed coins in accordance with claim 1 wherein said coins are United States coinage and said selected denomination is a penny.

4. The method of counting and segregating mixed coins in accordance with claim 3 wherein said coins are those of the United States and wherein said sorting step removes the coins in said mixed stream by diameter with any dimes in said stream being channeled to the stream of the mixed coins which are of denomination larger than pennies.

5. The method of counting and segregating mixed coins in accordance with claim 1 wherein said coin sorting step offsorts said segregated coins of said selected denomination from the stream of coins exiting the counting step into said second vault chamber, while the stream of the remaining mixed coins is directed into said first vault chamber.

6. The method of counting and segregating mixed coins in accordance with claim 1 wherein there is included the step of removing from said stream of coins, foreign, mutilated and counterfeit coins, and separately discharging said removed coins.

7. The method of counting and sorting mixed coins in accordance with claim 1 wherein said vault chambers are separable and wherein there is included the step of weighing said second vault chamber to determine the weight of the coins therein and thereby the total value of the coins of said selected denomination therein.

8. The method of counting and segregating mixed coins in accordance with claim 1 including the steps of periodically transporting said vault chambers with the coins therein to a processing center and weighing said segregated coins in said second chamber to determine the value thereof.

9. The method of counting and segregating mixed coins in accordance with claim 8 wherein said vault chambers are formed in a single vault and wherein there is included the step of removing said mixed coins of other denominations from said first chamber and weighing said vault thereafter.

10. The method of counting and segregating mixed coins in accordance with claim 8 wherein there is included the step of removing said mixed coins of other denominations from said first chamber and counting and sorting said mixed coins.

11. A coin processor for counting coins of mixed denominations and segregating coins of a selected denomination from those of other denominations comprising:

(a) a housing having an upper portion and a lower portion providing a vault receiving chamber;

(b) a vault removably seated in said vault receiving chamber and providing a first coin receiving chamber and a second coin receiving chamber;

(c) a coin counter in said upper portion for receiving coins of mixed denominations and counting all coins;

(d) a coin sorter in said upper portion for segregating a stream of mixed coins extending said counter into a stream of coins of a selected denomination and a stream of mixed coins of other denominations;

(e) a first conduit for the stream of coins of other mixed denominations to said first chamber in said vault;

(f) a second conduit for the stream of coins of said selected denomination to said second chamber in said vault; and (g) indicia providing means for displaying the total value of the counted coins.

12. The coin processor in accordance with claim 11 wherein said first chamber is removable from said vault and said vault has a door to access said first chamber and which may be locked for security.

13. The coin processor in accordance with claim 11 wherein said vault has separate discharge ports for each of said chambers through which the coins therein may be separately discharged.

14. The coin processor in accordance with claim 11 wherein said coin sorter includes a channel for a stream of coins and means along said channel for segregating the coins of the selected denomination.

15. The coin processor in accordance with claim 11 wherein the coins to be sorted are those of the United States with the selected denomination being a penny and wherein said sorter includes means for combining dimes with the stream of larger diameter coins.

16. The coin processor in accordance with claim 11 wherein said counter includes means for removing foreign, counterfeit and mutilated coins and a discharge chute for said removed coins.

17. The coin processor in accordance with claim 11 wherein said housing has an opening therein through which said vault may be removed, and access door closing the opening and means for locking said access door.

18. The coin processor in accordance with claim 17 wherein said vault has recesses in its bottom portion for seating the forks of a fork lift to move the vault.

19. The coin processor in accordance with claim 11 wherein said vault has a discharge opening for said first chamber through which the coins of mixed denominations may be drained.

20. The coin processor in accordance with claim 11 wherein said indicia providing means is a printer.

21. The coin processor in accordance with claim 17 wherein said vault has wheels thereon for movement thereof and an engageable element which can be engaged to remove said vault from said housing.

* * * * *